United States Patent [19]

Smith

[11] 3,985,014

[45] Oct. 12, 1976

[54] PORTABLE APPARATUS FOR USE ON A WRECKED VEHICLE BY A RESCUE SQUAD

[76] Inventor: Cecil J. Smith, 308 Forest Ave., Albemarle, N.C. 28001

[22] Filed: Oct. 12, 1973

[21] Appl. No.: 405,879

[52] U.S. Cl. ..... 72/457; 72/705

[51] Int. Cl.[2] ..... B21D 1/12

[58] Field of Search ..... 72/705, 457; 254/93 R, 254/93 VA

[56] References Cited

UNITED STATES PATENTS

| | | | |
|---|---|---|---|
| 3,034,564 | 5/1962 | Cavazos | 72/705 X |
| 3,122,194 | 2/1964 | Bronson et al. | 72/705 X |
| 3,149,659 | 9/1964 | Bogert, Jr. | 72/705 X |
| 3,149,660 | 9/1964 | Smith | 72/705 X |
| 3,292,410 | 12/1966 | Baldassano | 72/705 X |
| 3,501,938 | 3/1970 | Sprague | 72/705 X |
| 3,729,978 | 5/1973 | Lunardini | 72/705 X |
| 3,776,022 | 12/1973 | Lionello | 72/705 X |

*Primary Examiner*—C.W. Lanham
*Assistant Examiner*—D. M. Gurley
*Attorney, Agent, or Firm*—Richards, Shefte & Pinckney

[57] ABSTRACT

Portable apparatus for use in spreading or otherwise shifting parts of a wrecked vehicle to permit removal of occupants in such vehicle, including a U-shaped support member having a longitudinally extending base and two arm members extending perpendicularly therefrom, such arm member having chains and chain hoists attached thereto whereby the chains can be attached to selected parts of the vehicle and such selected parts can be spread or pulled away from one another by operating the chain hoists. The U-shaped support member is composed of a plurality of small components which are readily portable and which can be quickly assembled in rigid relation to one another at a rescue site. The U-shaped support may include stabilizer members extending outwardly therefrom to stabilize the U-shaped support in an upright position for some rescue operations.

2 Claims, 8 Drawing Figures

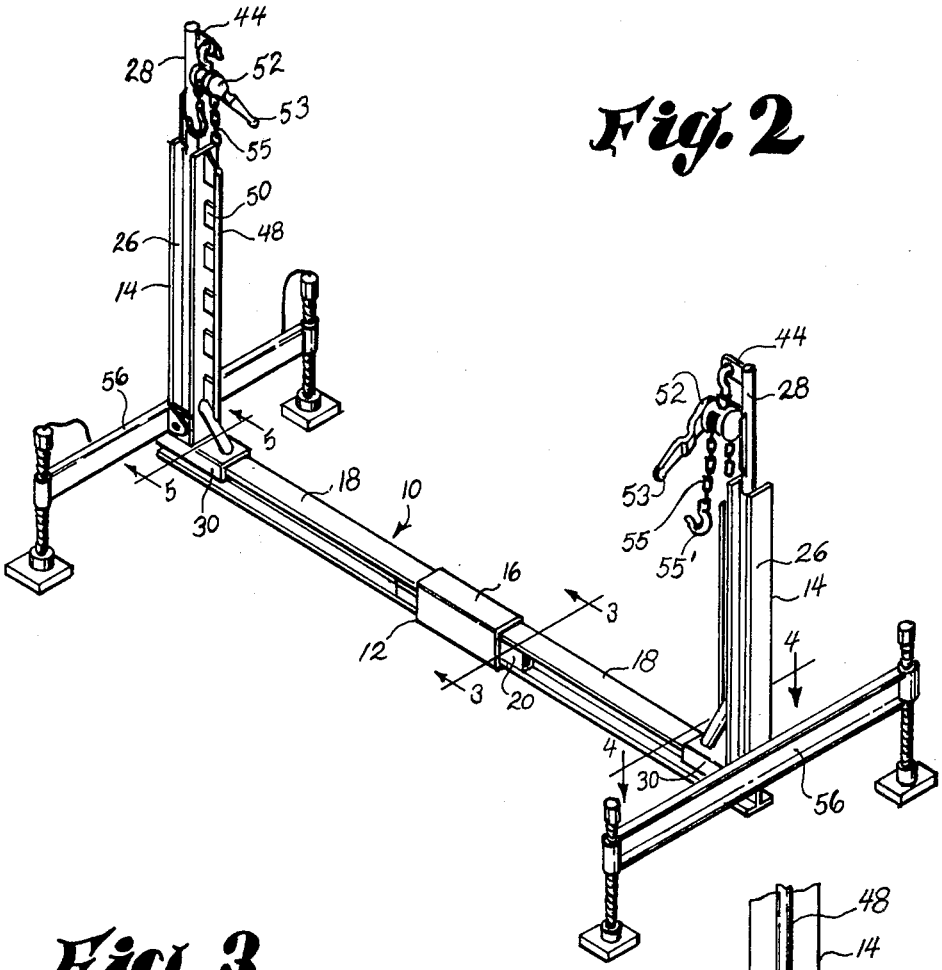
Fig. 2
Fig. 3
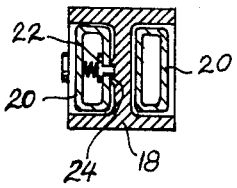
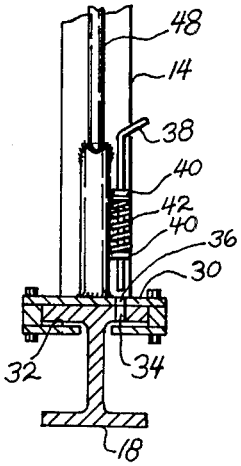
Fig. 4
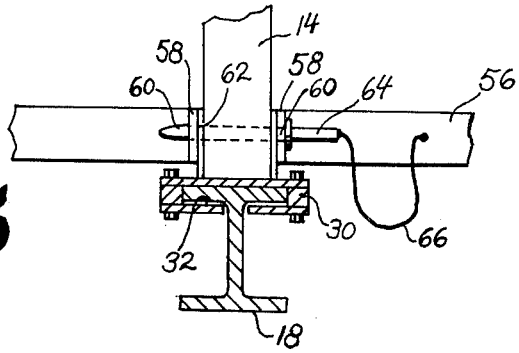
Fig. 5

PORTABLE APPARATUS FOR USE ON A WRECKED VEHICLE BY A RESCUE SQUAD

BACKGROUND OF THE INVENTION

Injuries received by the occupants of a wrecked vehicle often become more serious, in some cases even fatal, because of the inability of a rescue squad or other emergency personnel to remove the occupants from the vehicle promptly so that such occupants can receive immediately any necessary medical assistance. This inability to remove occupants results primarily from the fact that the occupants are pinned between badly crushed portions of the wrecked vehicle, or because there is no opening in the crushed vehicle which is large enough to permit the occupant to be reached or removed from the vehicle.

In attempting to remove such occupants from a wrecked vehicle, rescue squads have heretofore employed a variety of tools with varying degrees of success, principally acetylene torches, crowbars or similar prying tools, and jacks. Acetylene torches have the obvious disadvantage of presenting an exposed flame which could further injure the occupant, and which may be extremely dangerous when gasoline fumes are present at the accident site. Additionally, the removal of vehicle parts by using acetylene torches is relatively slow. Crowbars or similar prying tools are often ineffectual because it is impossible to obtain a proper pivot point in the wreckage which will provide the necessary mechanical advantage to separate the crushed metal of the vehicle, and jacks frequently cannot be used effectively because there is no opening in the vehicle which will permit the jack to be placed within the vehicle, or because there is no convenient base point against which the jack can bear in attempting to open or separate a crushed part of the vehicle.

It has also been heretofore proposed in U.S. Pat. No. 3,577,881, issued May 11, 1971, to employ a portable rescue unit designed principally for removing the doors of wrecked vehicles, such unit including a hydraulically operated pivot arm which is attached to a door of the vehicle, and an abutment plate engaging the frame of the vehicle beneath such door, the abutment plate acting as a stationary bearing point from which the pivot arm is moved to pull the attached door away from the vehicle frame. While this unit may be effective for removing vehicle doors in many instances, its application is generally limited because it is often impossible to locate a rigid point (i.e., the vehicle frame) on the wrecked vehicle in the vicinity of the vehicle part to be moved against which the abutment plate can properly bear.

The apparatus of the present invention requires no such limited bearing point on the vehicle frame or otherwise, and it has substantially universal application in quickly spreading or separating any bent or crushed portion of the vehicle.

SUMMARY OF THE INVENTION

In accordance with the present invention, a U-shaped, rigid support is provided, and a chain and chain hoist, or other equivalent pulling line, is associated with each extending arm member of the U-shaped support. When it is determined which part of a wrecked vehicle is to be spread or separated, the U-shaped support is disposed exteriorly of the vehicle with one arm in the vicinity of the selected vehicle part and with the other arm in the vicinity of any other rigid part of the vehicle within the reach of the extending length of the U-shaped support. The chains are then attached to such parts, respectively, and one or both of the chain hoists are operated to pull one or both of the chains toward its associated support arm to thereby separate or spread the two parts.

Preferably the base member of the U-shaped support has an extending length which at least exceeds the width of the vehicle whereby the two support arms can be readily located on each side of the vehicle so that such sides can be pulled away from each other. Because the base member can be placed under or over the vehicle, or along the length thereof, or at substantially any other position with respect to the vehicle, the apparatus of the present invention has substantially universal application in separating any desired part of the vehicle and in selecting the direction of the pulling force to be applied to such part as it is being separated.

The U-shaped support is preferably composed of a plurality of separable elements which can be readily disassembled for easy transportation to and from the site of an accident and which can be quickly and easily assembled in rigid form at such accident site. The base member of the U-shaped support includes a center piece which receives and attaches to two end pieces in the form of H-beams, and the arm members are slidably mounted on the flanges of such end piece H-beam so as to be selectively positionable along the length of the base member. The arm members may include selectively connecting parts for extending the length thereof, and they are provided with a number of openings to receive a hook attached to the chain hoists whereby such chain hoists may be located at a plurality of positions along the extending length of the arm members.

The apparatus of the present invention also includes stabilizer members which are selectively attachable to the U-shaped support for maintaining such support at a vertical disposition with the arm members of the support extending upwardly from the base member thereof. These stabilizer members include bracket portions for receiving the upstanding arm members and a pin element extending through the arm members and the bracket to maintain the stabilizer members in place at a disposition extending in perpendicular relation to the arm members and the base member of the U-shaped support. The extending ends of the stabilizer member may also include tubular portions for receiving adjustable legs to facilitate leveling or supporting the stabilizer members.

BRIEF DESCRIPTION OF THE DRAWINGS

FIG. 2 is a perspective view similar to FIG. 1 and showing the apparatus in assembled form;

FIG. 3 is a sectional view taken along line 3—3 in FIG. 2;

FIG. 4 is a sectional view taken along line 4—4 in FIG. 2;

FIG. 5 is a sectional view taken along line 5—5 in FIG. 2;

DESCRIPTION OF THE PREFERRED EMBODIMENT

Looking now in greater detail at the accompanying drawings, the disclosed embodiment of the present invention includes a U-shaped support 10 formed with a longitudinally extending base member 12 and a pair of arm members 14 attached to the base member 12 and extending perpendicularly therefrom.

Figure 1:
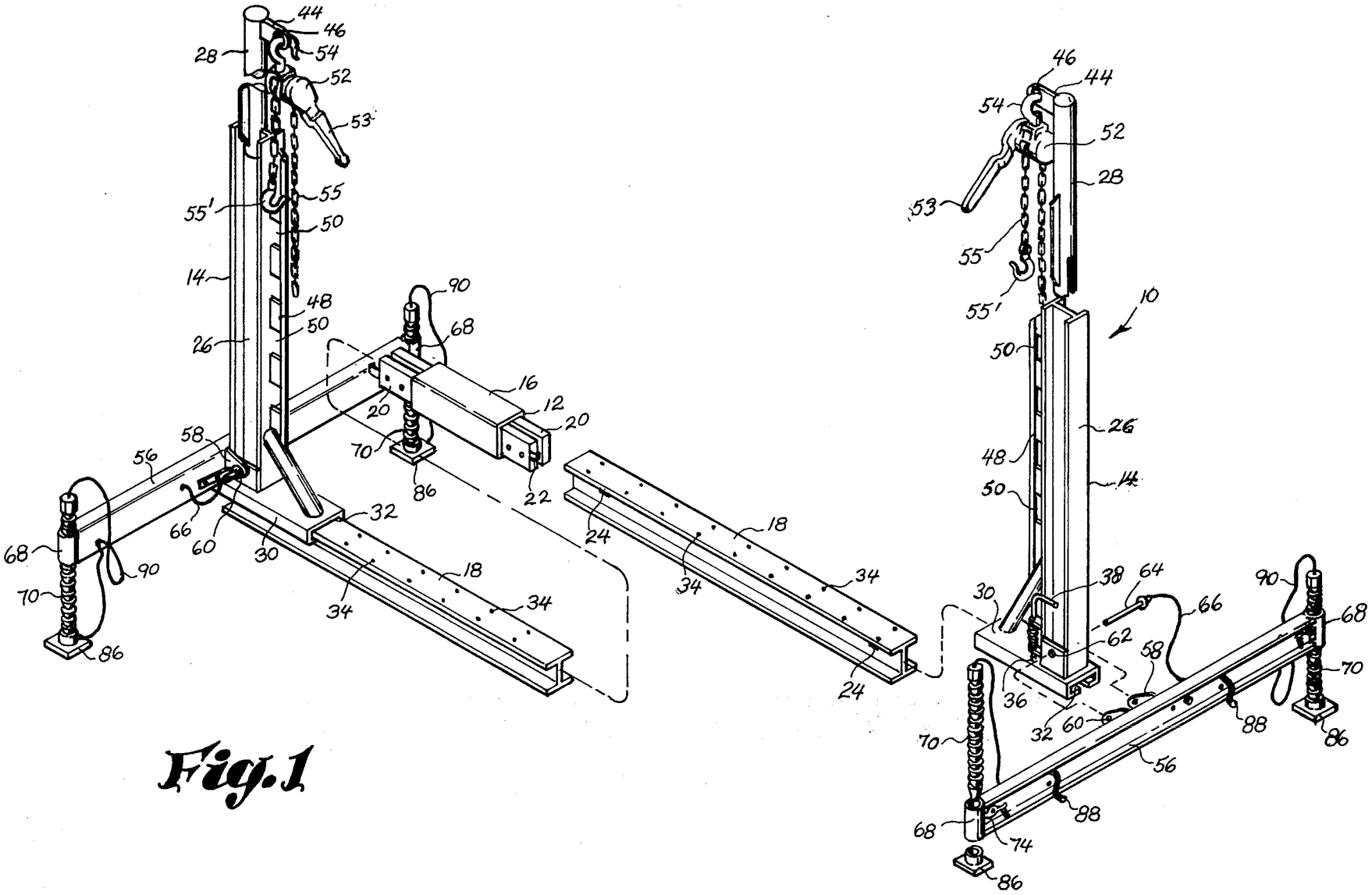
FIG. 1 is an exploded perspective view of the apparatus of the present invention.

The base member 12 is preferably made up of a plurality of smaller parts which can be readily assembled in rigid relation to one another at the site of an accident and which can be easily disassembled so as to be entirely portable. Thus, in the disclosed embodiment of the present invention, the base member 12 is divided into a center element 16 and two end elements 18. As best seen in FIGS. 1 and 3, the center element 16, at each end thereof, includes a pair of hollow projections 20 spaced apart to receive therebetween the web portions of the end elements 18 which are in the form of H-beams. One of the projections 20 at each end of the center element 16 has mounted therein a spring biased catch 22, and the web portions of the end elements 18 have formed thereon raised portions 24 which are appropriately spaced from each end of the end elements 18 to be engaged by the catch 22 when the web portion of the end elements 18 are assembled between the projections 20 of the center element 16. These raised portions 24 are placed at both ends of the end elements 18 so that either end thereof may be assembled with the center element 16, and it is apparent that the catch 22, by engaging a raised portion 24, will maintain the end elements 18 and the center element 16 in assembled relation until the catch 24 is removed from engagement with a raised portion 24 by moving it against the urging of its spring bias.

The two arm members 14 are identical, and they each include an I-beam portion 26 to which an extension element 28 may be assembled by a slot formed therein which engages the web of the I-beam portion 26 at one end thereof as best seen in FIG. 1. The other end of the I-beam portion 26 includes an integral foot element 30 formed with a slot 32 designed to slidably engage and receive a flange of the H-beam end elements 18 as best seen in FIGS. 1 and 4. These flanges of the end elements 18 include a line of spaced apertures 34 adjacent each side edge thereof, and the foot element 30 also includes an aperture 36 located therein to register with the apertures 34 as the foot element 30 slides along the flange of the end element 18. It will be noted that the aperture 36 in the foot element 30 is offset from the center thereof so that the aperture 36 can register with either line of apertures 34 in the end element 18 whereby either foot element 30 can be slidably mounted on either end element 18 even if the foot elements 30 face oppositely from their positions shown in FIGS. 1 and 2. To maintain the foot element 30 at any selected position along an end element 18 where the aperture 36 registers with one of the apertures 34, a spring biased pin 38 is carried by each foot element 30 for movement between a raised position (FIG. 4) at which the foot element 30 is freely slidable along the flange of the end element 18, and a lowered position at which the pin 38 extends through registered apertures 34, 36 and maintains the foot element 30 in place on the end element 18. The pin 38 is carried by mounting brackets 40, and may be arranged in any conventional manner to be rotated to one position at which it is maintained at its raised position against the bias of an associated spring 42, and rotated to a second position at which the spring 42 urges it to its lowered position within the registered apertures 34, 36.

The arm member extension 28 includes a projection 44 formed with an opening 46 therein, and the I-beam portion 26 of the arm member 14 includes a projecting flange 48 having a plurality of openings 50 spaced along the longitudinal extent thereof, the openings 46 and 50 presenting a plurality of locations on the arm member 14 at which a chain hoist 52 may be attached by a hook 54 formed integrally with the chain hoist 52. The chain hoists 52 are of conventional construction and may be of the type disclosed for example in U.S. Pat. No. 3,139,268, issued June 30, 1964, and includes an extending handle 53 and a link chain 55 carried in the housing of the chain hoists 52. The chain 55 may be provided with a hook 55' at one end thereof, and the chain hoist 52 is arranged so that a manual turning of the handle 53 will selectively retract or extend the length of chain 55 between the end hook 55' and the housing of the chain hoists 52, the chain hoists 52 and the extending handle 53 thereof providing a substantial mechanical advantage in exerting a large force on the end hook 55' as it is pulled toward the chain hoist housing. As pointed out above, the chain hoist 52 may be mounted in the opening 46 as shown in FIG. 1, or it may be mounted at any of the openings 50 by placing the hoist mounting hook 54 in such openings 50.

When it is necessary or desirable to utilize the U-shaped support 10 in a vertical, upright position as shown in FIG. 2, a pair of identical stabilizer members 56 are provided for attachment to the U-shaped support 10 whereby it will be braced against any sidewise leaning. Each stabilizer member 56 includes a pair of projecting brackets 58 having a spacing therebetween which corresponds to the width of the arm member 14, the brackets 58 being formed with aligned apertures 60. Each arm member 14 is likewise provided with an aperture 62 extending therethrough near the foot element 30, and the arm members 14 may be received between the brackets 58 so that aperture 62 will register with the aligned apertures 60 after which a pin 64 is placed through the registered apertures 60, 62 to maintain the stabilizer member 56 in place at a disposition extending perpendicularly with respect to the arm members 14 and the base member 12. The pin 64 is attached to the stabilizer member 56 by a short cable 66 to prevent its being inadvertently lost or misplaced, and, if desired, a spring loaded latch (not shown) or other conventional retainer may be mounted on the stabilizer member 56 to keep the pin 64 in the aligned apertures 60, 62.

Figure 6:
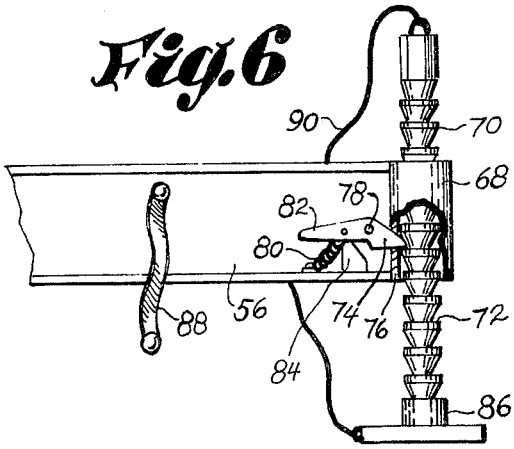
FIG. 6 is a detail view partially broken away, illustrating the mounting arrangement of a leg element in the stabilizer member of the present invention.

Each end of each stabilizer member 56 has secured thereto a tubular portion 68 for slidably receiving therein a leg element 70 which has a plurality of ratchet-type teeth 72 formed on the outer surface thereof as best seen in FIG. 6. Each tubular portion 68 is provided with a ratchet pawl 74 extending into the tubular portion through an opening 76 therein, the ratchet pawl 74 being mounted for pivotal movement about a pivot pin 78 and including a biasing spring 80 for urging the pawl 74 in a counterclockwise direction and into engagement with the ratchet teeth 72. An extension 82 is added to the ratchet pawl 74 to permit it to be manually pivoted in a clockwise direction for disengaging the pawl 74 and the teeth 72, and an abutment 84 may be added to prevent counterclockwise movement of the pawl 74 beyond a desired point. It will be apparent that the ratchet pawl 74 can be pivoted clockwise against the bias of spring 80 to permit sliding movement of the leg 70 within the tubular end portion 68 whereby the position of the leg 70 can be selectively adjusted, and the ratchet pawl 74 is then released whereupon the spring 80 will move the ratchet pawl 74 into engagement with the teeth 72 to prevent further sliding movement of the leg 70 in the tubular portion 68. The leg 70 may include a base 86 formed with a tubular receptacle for receiving an end of leg 70 whereby the leg 70 will rest upon a larger supporting area, and rubber straps 88 may be secured to the stabilizer member 56 for holding the leg 70 and base 86 in place thereagainst when these elements are not in use, thereby reducing the number of pieces which must be carried when the apparatus is being transported from one place to another. A cable 90 is attached between the leg 70 and the base 86 to prevent their being separated and perhaps lost.

Figure 7:
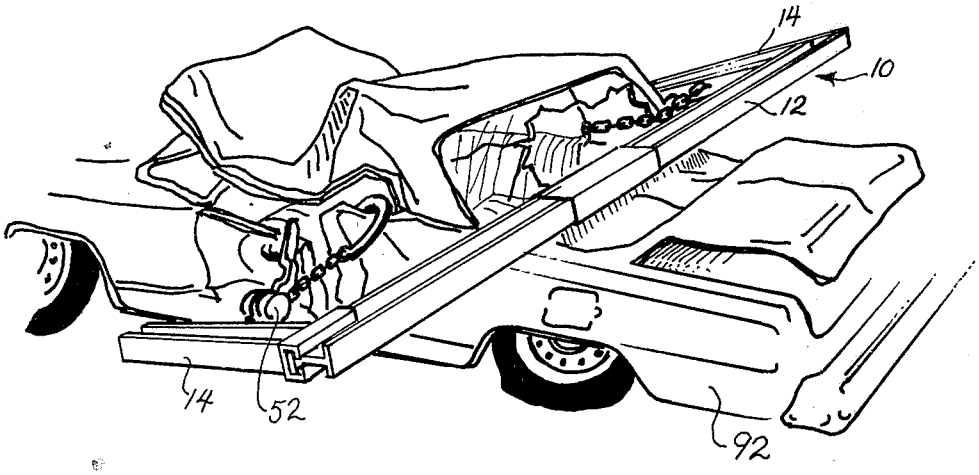
FIG. 7 is a perspective view illustrating one operative position of the apparatus of the present invention on a wrecked vehicle.
Figure 8:
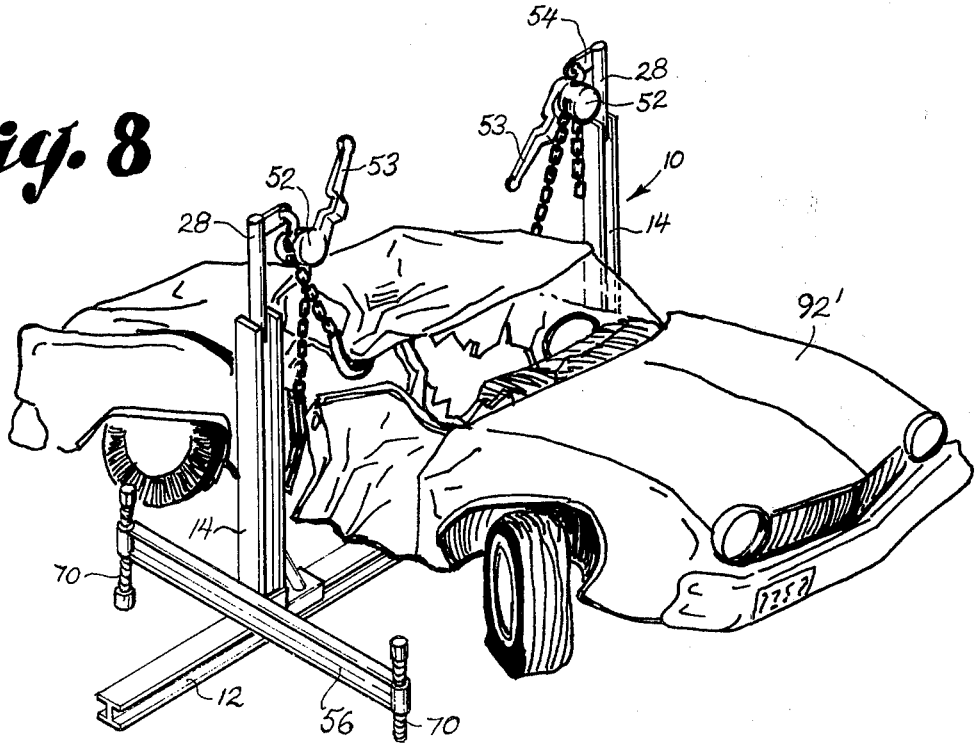
FIG. 8 is a perspective view illustrating another operative position of the apparatus of the present invention.

The above-described apparatus has a wide variety of uses in spreading or otherwise manipulating a wrecked vehicle at the site of an accident to promptly remove occupants who may be trapped or pinned within the vehicle, two representative uses being illustrated in FIGS. 7 and 8. In FIG. 7, the vehicle 92 has a crushed side, and the apparatus of the present invention is used to pull the side of the vehicle outwardly. As indicated previously, the U-shaped support 10 is composed of a plurality of relatively small elements which can be readily transported to an accident site, and quickly assembled at such site. After the U-shaped support 10 is assembled, it is positioned across the vehicle 92, as shown in FIG. 7 with one arm member 14 in the vicinity of the vehicle part to be spread or pulled, and the other arm member 14 adjacent another part of the vehicle 92 generally opposite from the part to be pulled. The chain hoists 52 are then attached to the arm members 14 at convenient openings 50 along the lengths thereof, and one chain 55 is hooked or otherwise attached to the vehicle part to be pulled while the other chain 55 is likewise attached to another oppositely located part of the vehicle 92, preferably one which is rigid. By operating the handle 53 of one or both of the hoists 52, it will be apparent that the two parts of the vehicle 92 to which the chains 55 are attached will be pulled apart or spread. If one chain 55 is attached to a rigid part of the vehicle 92 and the other to a crushed, and therefore weakened, part of the vehicle 92, the crushed part will in almost all cases be pulled out or straightened to permit release or removal of an occupant. It is to be noted, of course, that the stabilizer members 56 are not needed or used in the application of the apparatus of the present invention shown in FIG. 7, and it will be apparent that the general configuration of the U-shaped support 10 will allow it to be placed in a great variety of positions over, above, across and alongside the vehicle 92 so that there is practically no part of the vehicle 92 which cannot be reached and pulled out by the U-shaped support 10.

FIG. 8 illustrates another common application of the apparatus of the present invention in lifting the crushed roof of a vehicle 92'. As seen in FIG. 8, the U-shaped support 10 is arranged in a vertically upright position with stabilizer members 56 being used to maintain the U-shaped support at such position. The arm member extensions 28 are used, and the hoists 52 are attached thereto. The chains 55 are hooked at the roof of the vehicle 92' whereby operation of the hoists 52 will raise the crushed roof of the vehicle 92'.

As indicated above, there are of course a wide variety of other applications of the apparatus of the present invention which are too numerous to recount in detail here. It is believed apparent from the examples given above that the U-shaped support 10 can be placed at substantially any position relative to a crushed vehicle to permit pulling of a particular part in a particular direction, and thus versatility, combined with the facility of the present invention to be quickly assembled and disassembled, qualify the apparatus for general utility by an emergency rescue squad.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

I claim:

1. Portable apparatus for use by an emergency rescue squad in spreading and shifting a wrecked vehicle at the site of an accident to remove injured persons therefrom, such apparatus including a portable U-shaped support consisting solely of a rigid base member having a longitudinal extent which at least exceeds the width of such vehicle and a pair of arm members attached to said base member at spaced locations therealong and extending from said base member in perpendicular relation thereto, the configuration, dimensions and structural arrangement of said portable U-shaped support permitting it to be selectively operable and positionable over, under, across, alongside, in front of or in back of said wrecked vehicle, an attachment line means associated with each of said arm members, respectively, and including means for securing one end of said attachment line means to said vehicle, and actuator means associated with at least one of said attachment line means for selectively shortening the length of said attachment line between said associated arm member and said vehicle, characterized in that said base member is divided into three elements formed with means at the respective ends thereof permitting selective assembly of said base elements rigidly together in lengthwise relation to form said base member and permitting selective disassembly of said base elements for readily transporting the same, and further characterized in that said three base elements comprise a center element and two end elements, said end elements being in the form of H-beams and said center element including slots at each of its respective ends to receive the webs of said end element H-beams, and said center element including holding means for selectively engaging the webs of said end element H-beams to maintain said center element and said end elements in engagement.

2. Portable apparatus for use by an emergency rescue squad in spreading and shifting a wrecked vehicle at the site of an accident to remove injured persons therefrom, such apparatus including a portable U-shaped support consisting solely of a rigid base member having a longitudinal extent which at least exceeds the width of such vehicle and a pair of arm members attached to said base member at spaced locations therealong and extending from said base member in perpendicular relation thereto, the configuration, dimensions and structural arrangement of said portable U-shaped support permitting it to be selectively operable and positionable over, under, across, alongside, in front of or in back of said wrecked vehicle, an attachment line means associated with each of said arm members, respectively, and including means for securing one end of said attachment line means to said vehicle, and actuator means associated with at least one of said attachment line means for selectively shortening the length of said attachment line between said associated arm member and said vehicle, characterized in that a longitudinally extending stabilizer member is removably attached to each of said arm members of said U-shaped support, said stabilizer members extending in perpendicular relation to said base member and said arm member of said U-shaped support, characterized in that each of said arm members has an aperture therein located adjacent the point at which said arm member is attached to said base member of said U-shaped support, in that each of said stabilizer members includes a pair of projecting bracket members having apertures formed therein, said pair of bracket members receiving one of said arm members therebetween with the apertures of said bracket members being registered with said apertures in said arm members, respectively, and in that a pin element is selectively insertable through said registered apertures to maintain said stabilizer members in place and attached to said U-shaped support, and further characterized in that each of said stabilizer members includes a tubular portion at each end thereof with a ratchet pawl extending into each of said tubular portions, and in that an adjustable leg element having ratchet teeth formed therein is slidably mounted in each of said tubular portions, said ratchet pawl selectively engaging said ratchet teeth to prevent sliding movement of said leg element in one direction through said tubular portion.

* * * * *